US009103162B2

(12) United States Patent
Mader et al.

(10) Patent No.: US 9,103,162 B2
(45) Date of Patent: Aug. 11, 2015

(54) DEVICE FOR APPLYING SPACER TAPE

(75) Inventors: Leopold Mader, Neuhofen/Ybbs (AT); Leopold Karner, Krummnussbaum (AT)

(73) Assignee: LISEC AUSTRIA GMBH, Seitenstetten (AT)

( * ) Notice: Subject to any disclaimer, the term of this patent is extended or adjusted under 35 U.S.C. 154(b) by 217 days.

(21) Appl. No.: 13/376,900

(22) PCT Filed: Oct. 14, 2010

(86) PCT No.: PCT/AT2010/000394

§ 371 (c)(1),
(2), (4) Date: Dec. 8, 2011

(87) PCT Pub. No.: WO2011/047398

PCT Pub. Date: Apr. 28, 2011

(65) Prior Publication Data

US 2012/0085499 A1 Apr. 12, 2012

(30) Foreign Application Priority Data

Oct. 22, 2009 (AT) ..... A 1665/2009

(51) Int. Cl.
*E06B 3/673* (2006.01)
*E06B 3/66* (2006.01)

(52) U.S. Cl.
CPC ..... *E06B 3/6733* (2013.01); *E06B 3/673* (2013.01); *E06B 3/67321* (2013.01);
(Continued)

(58) Field of Classification Search
CPC ..... E06B 3/663; E06B 3/673; E06B 3/54; E06B 3/5409; E06B 3/58; E06B 3/67321; E06B 3/67326; E06B 3/6733; E06B 3/677; C06C 27/00; C03C 27/10; C03C 27/06; B32B 17/10; B65H 79/00; B29C 63/0026; B29C 66/4722; Y10T 156/12; Y10T 156/1348; Y10T 156/1357; Y10T 156/1361
USPC ..... 156/538, 510, 543, 578
See application file for complete search history.

(56) References Cited

U.S. PATENT DOCUMENTS 4,708,762 A 11/1987 Lenhardt
5,246,331 A * 9/1993 Hallahan et al. ..... 414/676

(Continued)

FOREIGN PATENT DOCUMENTS

DE 2906077 A1 8/1979
DE 3 002 904 8/1980

(Continued)

OTHER PUBLICATIONS

International Search Report dated Apr. 19, 2011, corresponding to PCT/AT2010/000394.

(Continued)

*Primary Examiner* — Alex Efta
(74) *Attorney, Agent, or Firm* — Young & Thompson

(57) ABSTRACT

A device for applying an elastoplastic spacer tape as a spacer during the production of insulating glass panes has at least two supply reels for spacer tapes, several driven tape guide rollers, and a movable application head for the selected spacer tape, with whose assistance the spacer tape is pressed onto a glass pane. For coating one or the other spacer tape, a coating station with two coating nozzles is provided, from which adhesive glue is sprayed on the lateral surfaces of the selected spacer tape. The spacer tape that is unneeded in each case is stopped in the application head in such a way that one or the other of the spacer tapes as desired, depending on which spacer tape is required for the production of a special insulating glass pane, is applied to the glass pane. Thus, the laborious threading and unthreading of spacer tapes is not necessary.

19 Claims, 5 Drawing Sheets

(52) U.S. Cl.
CPC ..... *E06B 3/67365* (2013.01); *E06B 3/66* (2013.01); *E06B 2003/67378* (2013.01); *Y10T 156/12* (2015.01); *Y10T 156/1348* (2015.01); *Y10T 156/1357* (2015.01); *Y10T 156/1361* (2015.01); *Y10T 156/17* (2015.01); *Y10T 156/1712* (2015.01); *Y10T 156/1798* (2015.01)

(56) References Cited

U.S. PATENT DOCUMENTS

| | | | | |
|---|---|---|---|---|
| 6,325,324 | B1 * | 12/2001 | Getz et al. | 242/556.1 |
| 6,360,804 | B1 * | 3/2002 | Field et al. | 156/523 |
| 2005/0247392 | A1 * | 11/2005 | Lisec | 156/109 |
| 2006/0075869 | A1 * | 4/2006 | Calcei et al. | 83/650 |
| 2006/0080915 | A1 * | 4/2006 | Vianello et al. | 52/204.593 |
| 2009/0294571 | A1 * | 12/2009 | Calcei et al. | 242/564 |
| 2010/0065580 | A1 * | 3/2010 | McGlinchy et al. | 222/52 |

FOREIGN PATENT DOCUMENTS

| | | | |
|---|---|---|---|
| DE | 3539877 | A1 | 4/1987 |
| DE | 3637561 | A1 * | 5/1987 |
| DE | 4335673 | C1 | 5/1995 |
| DE | 1 021 2359 | | 10/2003 |
| DE | 103 50 312 | | 6/2005 |
| EP | 301983 | A1 * | 2/1989 |
| EP | 770755 | A1 * | 5/1997 |
| EP | 1 643 072 | | 4/2006 |
| FR | 002636380 | A1 * | 3/1990 |
| GB | 2015628 | A | 9/1979 |
| WO | 2006/003505 | | 1/2006 |

OTHER PUBLICATIONS

Austrian Office Action, dated Aug. 25, 2010, from corresponding AT application.

* cited by examiner

DEVICE FOR APPLYING SPACER TAPE

The invention relates to a device with the features of the preamble of claim 1.

BACKGROUND OF THE INVENTION

The spacers between the glass panes usually consist of one, two, or else more glass panes comprising insulating glass panes made of aluminum or steel hollow sections.

A spacer tape with a rectangular cross-section, frequently referred to as "swiggle strip," is known from DE-A-30 02 904, and said tape, provided with protective film, comes from a supply drum or reel and is applied to a glass pane by means of a device that is equipped with a reversible head. This spacer tape based on butyl rubber is viscous plastic, and strongly adhesive (which is desired for a gas-tight connection first with the first and later the second glass pane of the insulating glass panes), but it has a strong temperature-dependent viscosity.

More recently, significantly less temperature-sensitive elastoplastic spacer tapes have been developed based on polyurethane or the like, which also have rectangular cross-sections, are more shape- and dimensionally-stable than the so-called "swiggle strips," have a diffusion barrier, e.g., a lamination made of aluminum foil, on the subsequent outer side, and are provided—on the narrow sides intended for adhesion with the glass panes at the manufacturer's—with a thin coating of a strongly adhesive glue that is covered with protective foil until the spacer tape is applied.

A method and a device for applying such a spacer tape on glass panes of insulating glass panes that consist of at least two glass panes are known from DE-A-102 12 359.

A device for producing insulating glass panes is known from DE-A-103 50 312, and this device has a device for applying an elastoplastic spacer tape. This device for applying a spacer tape when insulating glass panes are being produced comprises a supply reel for the tape, several driven tape-guiding rollers, and a press head for the spacer tape that can move relative to a glass pane. In contrast to the state of the art, an elastoplastic spacer tape is used whose lateral surfaces are not yet coated with an adhesive. The latter is rather applied only shortly before the application of the spacer tape on its lateral surfaces. To this end, nozzles that are opposite to one another between the supply reel and the press head, which coat the lateral surfaces of the spacer tape with an adhesive, are provided.

Frequently, the problem occurs that an elastoplastic spacer tape, which is arranged as a spacer between the glass panes of an insulating glass pane, has to be deposited (applied) with another width if insulating glass panes are to be produced with air gaps that are measured in a different way. In the known devices (see above), this requires that the elastoplastic spacer tape is pulled out from the supply device (the application head), and a new spacer tape with a width that corresponds to the desired width (thickness) of the air gap is threaded.

This is a task that requires time, which is undesirable for modern insulating glass production plants, since short cycle lengths are already targeted for the sake of cost-effectiveness.

In particular, the problem occurs of elastoplastic spacer tapes having varying widths when multi-pane insulating glass (at least three panes) are produced and are to be present between the individual glass panes with air gaps of varying width.

SUMMARY OF THE INVENTION

The object of the invention is to indicate a device with which the switching of elastoplastic spacer tapes, which serve as spacers of insulating glass panes, is possible in a simple way.

This object is achieved according to the invention with a device that has the features of claim 1.

Preferred and advantageous configurations of the invention are the subject of the subclaims.

With the device according to the invention, the switching of elastoplastic spacer tapes is fast, and it is possible without laborious threading and unthreading.

Owing to the design according to the invention, the coating stations (nozzle head with two nozzle pairs) can easily be assigned for applying adhesive, e.g., butyl adhesive, on the lateral surfaces of the spacer tape to the spacer tape that is required in each case (spacer tape with the corresponding width), by the nozzle pair that is required in each case being activated.

Also, the device according to the invention allows the device to be designed for cutting the elastoplastic spacer tape into lengths, on the one hand, and the systems to be designed for producing V-shaped indentations (recesses) in the regions of the spacer tape, which later form corners of the spacer tape, on the other hand, in such a way that the spacer tape that is required in each case can be fed to them as desired.

The device according to the invention not only allows for spacer tapes with varying widths to be fed and to be applied to the glass pane as desired, but rather also for spacer tapes that are configured in different ways to be selected corresponding to the requirements that prevail in each case.

In the device according to the invention, at least two supply points (reels) are provided for elastoplastic spacer tapes that are used as spacers.

The feeding devices ("application heads") can be designed, moreover, as usual, for example as known from DE-A-103 50 312 or DE-A-102 12 359 or ultimately as known from WO 2006/003505 A. In this case, the feeding devices and the supply reels (supply drums) for the elastoplastic spacer tapes, which are used as spacers, can be arranged in any arrangement to one another, e.g., beside one another. Only in the regions where the nozzle head for the application of an adhesive glue and/or the device for cutting into lengths and the system for producing V-shaped indentations are provided can the spacer tapes be brought up close to one another.

Additional details and features of the invention follow from the description below of a preferred embodiment.

Here:

DETAILED DESCRIPTION OF THE PREFERRED EMBODIMENTS

Figure 1:
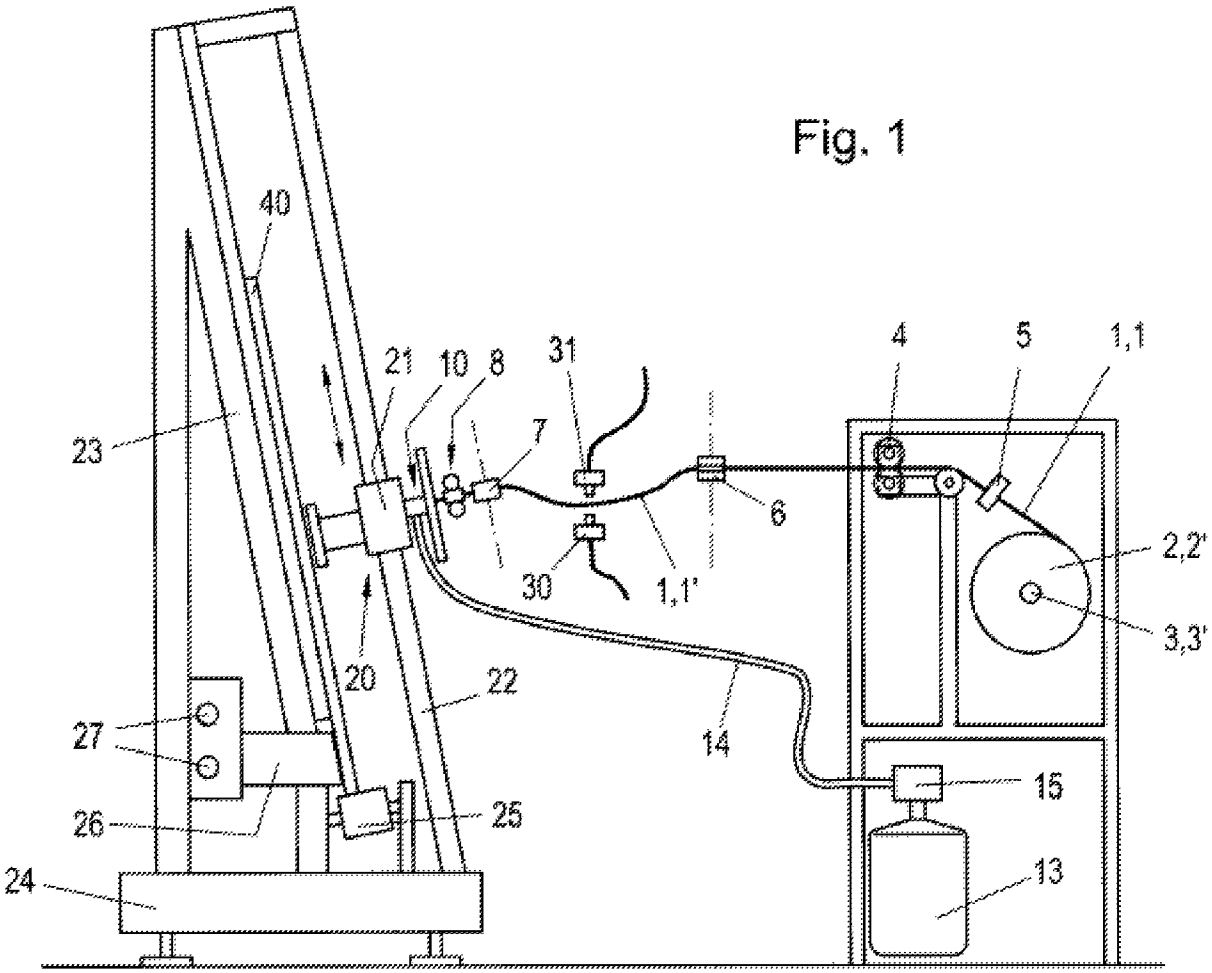
FIG. 1 shows a greatly simplified side view of a device for applying a spacer tape.

In the device of FIG. 1, elastoplastic spacer tapes 1, 1' with rectangular cross-sections (see FIG. 2) are drawn off from supply reels 2, which each sit on a driven shaft 3, via guide rollers 4 by optionally provided path measuring systems 5.

Then comes a segment in which the spacer tapes 1, 1' sag freely. The sagging is kept between an (upper) minimum value and a (lower) maximum value by lower sensors 30 and upper sensors 31, which are connected via signal cables to the machine control system (not shown), specifically in such a way that the machine control system acts on the reel and roller drives based on signals from the sensors 30 and 31. As a result, it is achieved that the spacer tapes 1, 1' run in without longitudinal stress, i.e., neither compressed nor stretched, via additional roller pairs such as 7 and 8 and then into an application head 20, which can be moved over a slot 21 in the direction of the double arrow on a column 22. The column 22 is slightly tilted against the vertical and parallel to a support wall 23, e.g., an air cushion support wall, which rests on a machine frame 24. A glass pane 40, whose lower edge is placed on a linear conveyor 25, e.g., a roller conveyor 25, leans against the support wall 23. The glass pane 40 can be transported in reverse with the linear conveyor 25, in particular supported by a negative-pressure conveyor 26, which can be moved on horizontal guides 27. The negative pressure conveyor 26 can be a vacuum suction device coupled to the linear conveyor 25 or a continuous vacuum conveyor belt.

For its part, the application head 20 is reversible around a shaft that is perpendicular to the column 22. By a relative movement of the application head 20 relative to the glass pane 40 and movement of the glass pane 40 itself, the spacer tape 1 or the spacer tape 1' is itself pressed near the edge rotating onto the glass pane 40.

The spacer tape 1 runs through a coating station 10, which is integrated in the application head 20, and the container 13, which contains an adhesive, e.g., a butyl adhesive, is connected via a line 14 to a pump 15. The coating station 10, in which an adhesive layer is applied on the lateral surfaces of the spacer tapes 1, 1', comprises two nozzle pairs 11, 12, which are together supplied with adhesive from the line 14.

Figure 2:
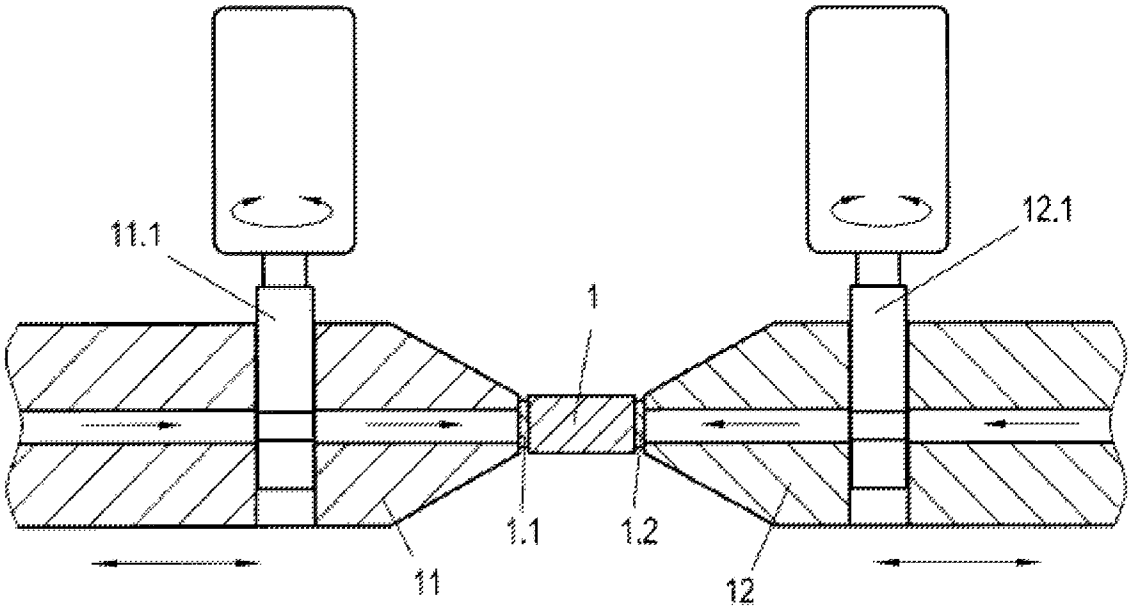
FIG. 2 shows the spacer tape in a cross-section between the coating nozzles on a greatly enlarged scale.

FIG. 2 diagrammatically shows a nozzle pair 11 and 12, arranged in the coating station 10, for applying adhesive to the lateral surfaces of the spacer tapes 1 and 1'. The flow of the adhesive through the nozzles 11 and 12 can be controlled or adjusted by means of slides 11.1 and 12.1 driven by servomotors in such a way that the lateral surfaces of the spacer tapes 1 and 1' are coated with one adhesive layer 1.1 or 1.2 each that has an essentially constant thickness, i.e., independent of the instantaneous speed of the tape 1. In this connection, the drive motors of the slides 11. 1 and 12.1 and optionally downstream thickness-measuring systems are connected to the machine control system (not shown). The nozzles 11 and 12 can be moved to adapt the distance between their outlets to the spacer tapes 1, 1' of varying widths corresponding to the double arrows.

Figure 3:
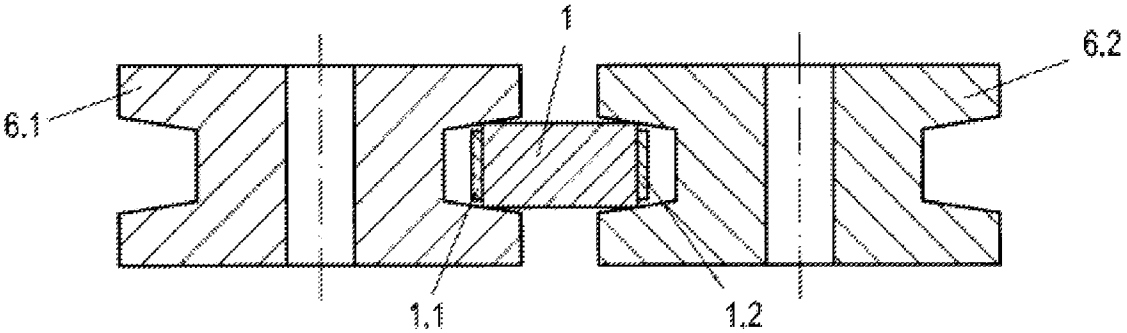
FIG. 3 shows a downstream roller pair for lateral guiding of the spacer tape, also on an enlarged scale.

In FIG. 3, the coating stations 10 of optionally downstream roller pairs are shown for lateral guiding of the spacer tape 1 of varying profiles in such a way that the rollers 6.1 and 6.2 that are depicted and the spacer tapes 1, 1' rest only on the edges of the lateral surfaces of the tape. The rollers, e.g., the rollers 6.1 and 6.2, can be designed free-wheeling or can sit on the shafts of drive motors, not shown, which keep the circumferential speed of the rollers synchronous and consistent with the instantaneous tape running speed or the tape running speed that is necessary at the instant.

Figure 4:
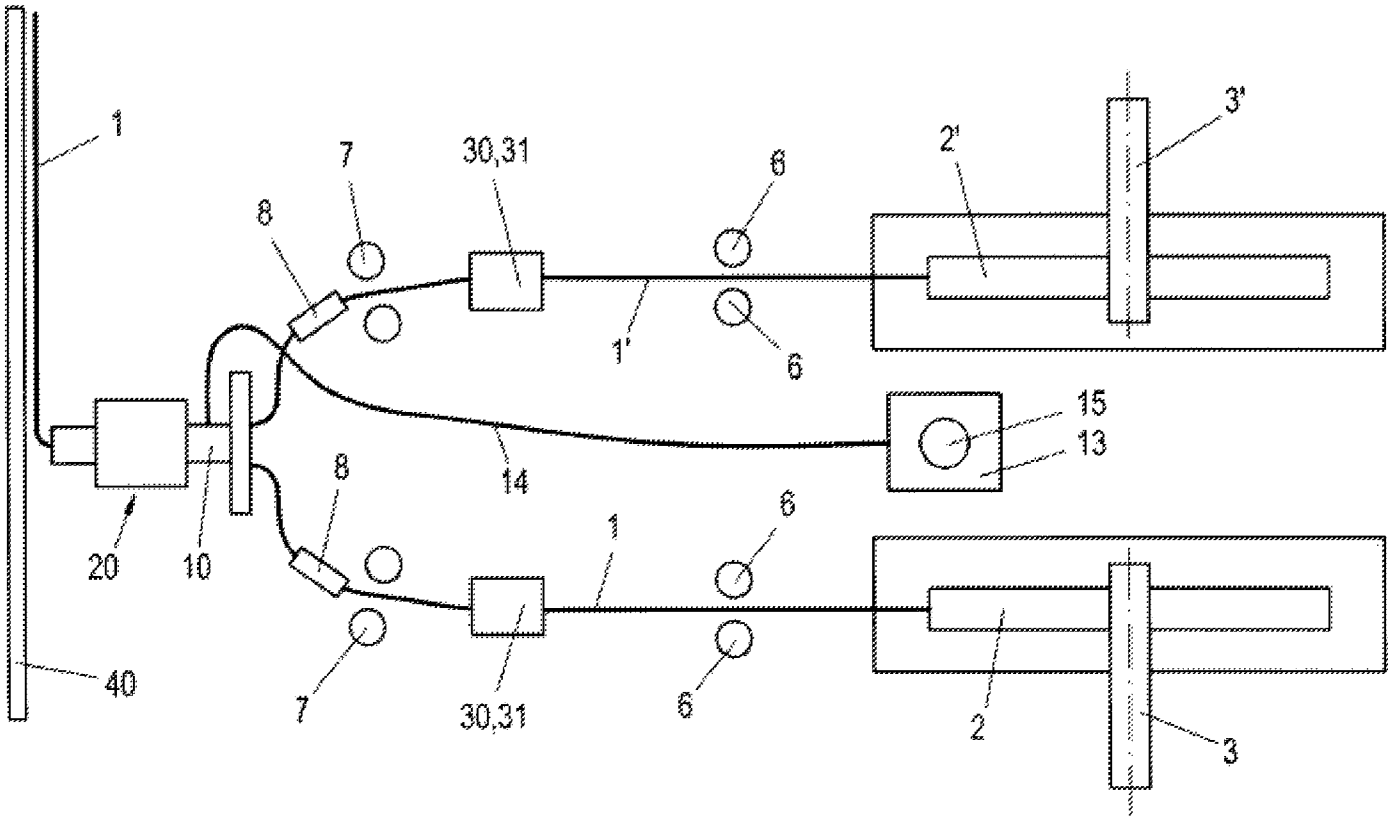
FIG. 4 shows, greatly simplified, a device for applying different spacer tapes, FIG. 5 partially shows an application head in oblique view, and FIG. 6 partially diagrammatically shows additional parts of an application head.

In the device according to the invention (cf. FIG. 4), two stations are provided with supply reels 2, with the rollers 4 as well as with the optionally provided path-measuring system 5.

In the application head 20, a coating station 10 is provided for the application of butyl adhesive. The coating station 10 is constructed, for example, as known from DE-A-103 50 312, but in the device according to the invention, it is designed in such a way that the spacer tape 1 or the spacer tape 1' is worked with it as desired, i.e., can be coated with adhesive by the selected nozzle pair 11, 12 to then be applied on the near surface of the glass pane 40. In this case, the spacer tapes 1 and 1' have different dimensions, colors and/or cross-sectional shapes.

In the device according to the invention, a device 50 (FIG. 5) is provided in the application head 20 for cutting through the tape 1, 1', in which the spacer tape 1 or 1' is cut into lengths to the length that is required in each case and in which using a system 51, V-shaped cutouts (recesses) or miter indentations (so that the spacer tape 1 or 1' can be bent at a sharp angle in the corner areas) can be produced. The device 50 can have a cutter for cutting spacer tape 1, 1' into lengths. In an alternative embodiment, the device 50 has a cutter with which spacer tape 1, 1' is cut into lengths, and for the system 51, said device 50 has another cutter, with which V-shaped cutouts can be made in the spacer tapes 1, 1'.

When, during use of the device according to the invention, spacer tape 1 has to be switched to spacer tape 1', since an insulating glass pane is to be made, which requires another spacer tape 1 as a spacer, for example, the spacer tape 1', the unneeded (no longer required) spacer tape 1 or 1' is stopped (e.g., clamped) in a system 70, and the required spacer tape 1' or 1, i.e., the tape with the desired dimensions/properties, is advanced and applied to the glass pane 40, whereby the procedure can be continued virtually free of interruptions.

It is considered within the framework of the invention that the device 50 and the system 51 are set up in such a way that they are suitable for cutting into lengths or V-shaped cutting-out of all cross-sectional shapes considered from elastoplastic spacer tapes 1, 1' that are used as spacers.

It should also be pointed out that although the invention is shown based on an embodiment with fixed discharge stations for spacer tapes 1, 1', the supply reels 2 for spacer tapes 1, 1' can also be designed to travel with the coating head 20. This embodiment is preferred in some applications.

Figure 5:
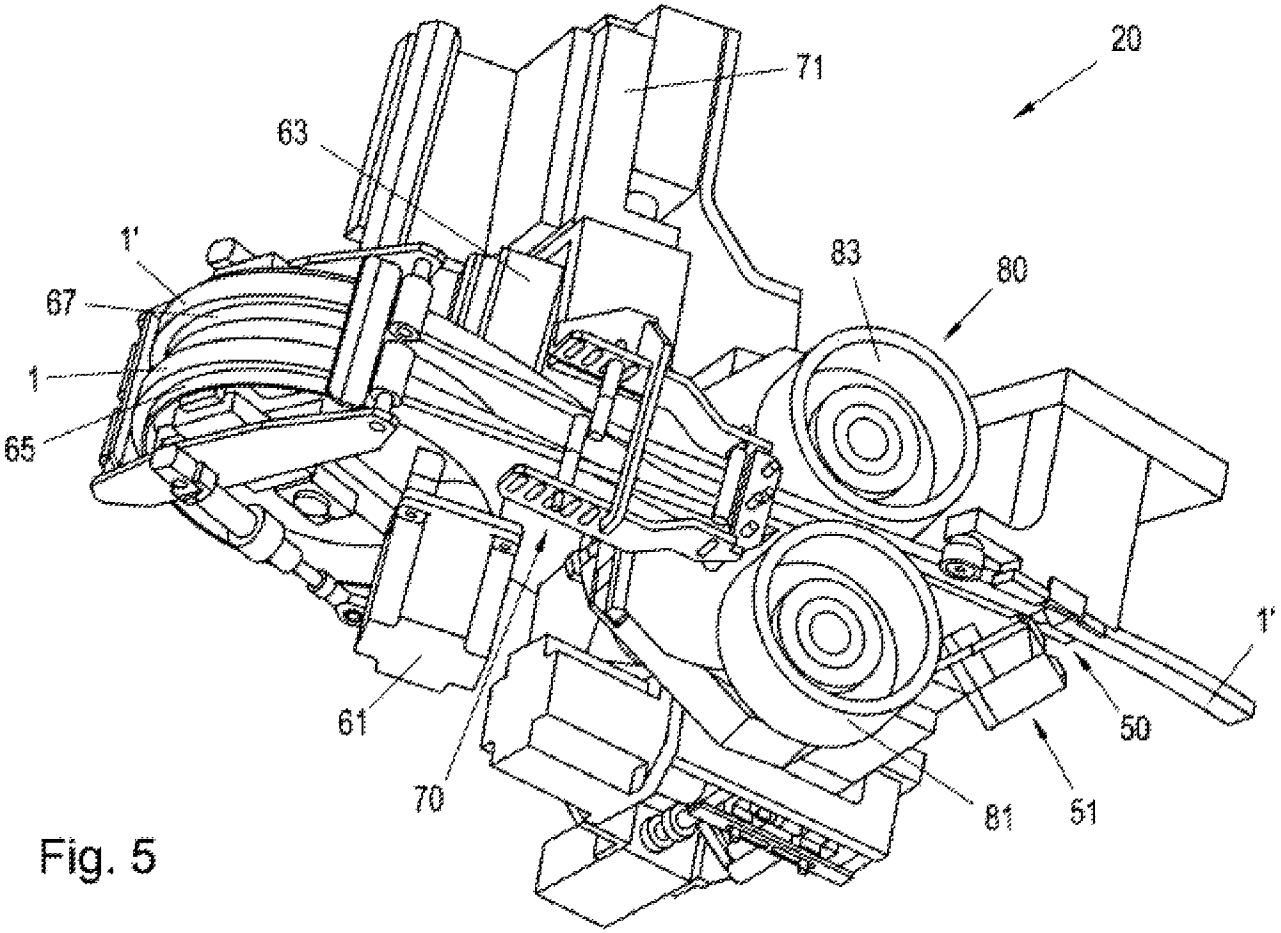
Figure 6:
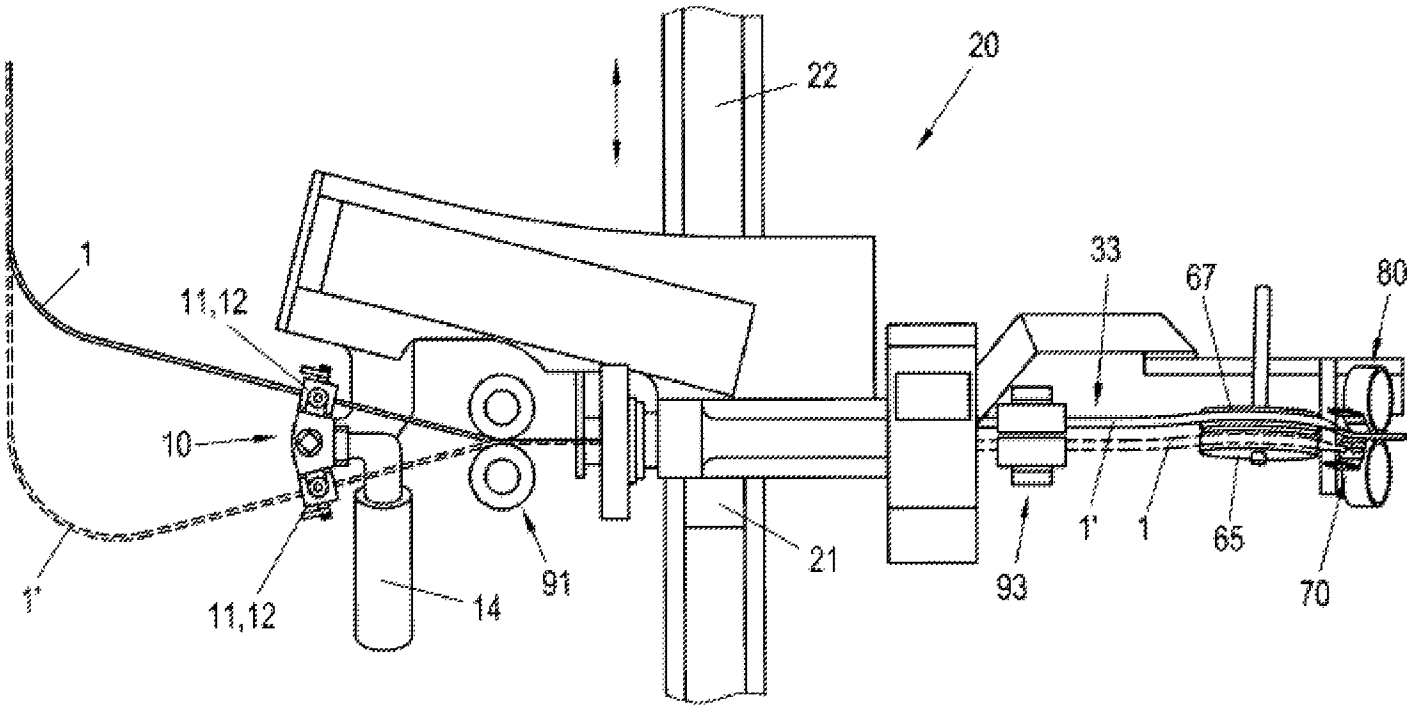

A preferred embodiment of an application head 20 is shown diagrammatically and with omission of individual components and linings in FIGS. 5 and 6. In the application head 20, the spacer tapes 1, 1' that are coated in the coating station 10 are guided by optionally driven roller pairs 91 and 93, pushed forward on sleds 21 past the deflecting rollers 65, 67. The deflecting rollers 65, 67 that are provided in the application head 20 for the spacer tapes 1, 1' can be driven independently of one another by two drive motors 61, 63. Connected to the deflecting rollers 65, 67, a system 70 is provided, which system can move crosswise to the locomotion direction of the spacer tapes 1, 1' using a drive 71, in such a way that only the spacer tape 1 or 1' that is required in each case is fed to a feed unit 80 for the selected spacer tape 1 or 1'. In this case, it is provided that the spacer tape that is unneeded in each case is stopped before the feed unit 80 with the two feed cylinders 81, 83; in particular, it is clamped in the system 70 to prevent it from sliding back out from the application head 20.

The roller pairs 91 and 93 are driven, depending on the speed with which the selected spacer tape 1 or 1' is fed (conveyed) by the feed device 80 with the feed cylinders 81 and 83, in such a way that the spacer tape 1, 1' sags between the roller pair 93 and the deflecting rollers 65 and 67, thus is neither compressed nor stretched (compression, just like stretching, can damage the diffusion barrier that is present on the spacer tape 1, 1'!).

The device 50 for cutting spacer tape 1, 1' to the length that is desired in each case and the system 51, which is equipped with a V-shaped blade or two blades 51 arranged in a V, to produce V-shaped cutaways in the spacer tape 1, 1' (as shown in FIG. 5) are arranged connected to the feed device 80.

It should also be pointed out that between each supply station with the supply reel 2 and the application head 20, a separate sag adjustment is assigned to the sensors 30, 31. This is important since the sag adjustment with the sensors 30, 31 also has the purpose of controlling the drive of the supply reel 2, so that it is achieved that the supply reel 2 is shut down with the unneeded tape 1 or 1' when the sag adjustment with the sensors 30, 31 determines that the sagging was too great.

For the control/adjustment of the sagging in the spacer tape 1, 1' between the roller pair 93 and the deflecting rollers 65, 67, sensors similar to the sensors 30 and 31 are provided at the site labeled by an arrow 33 in FIG. 6, i.e., where the sagging is present.

In summary, an embodiment of the invention can be described as follows:

A device for applying an elastoplastic spacer tape 1, 1' as a spacer during the production of insulating glass panes has at least two supply reels 2 for spacer tapes 1, 1', several driven tape guide rollers 4, 6, 7, 8 and a movable application head 20 for the selected spacer tape 1, 1', with whose assistance the spacer tape 1 or 1' is pressed onto a glass pane 40. For coating one or the other spacer tape 1, 1', a coating station 10 with two coating nozzles 11, 12 is provided, from which adhesive glue (butyl rubber) is sprayed on the lateral surfaces of the selected spacer tape 1, 1'. The spacer tape 1 or 1' that is unneeded in each case is stopped in the application head 20 in such a way that one or the other spacer tape 1, 1' as desired, depending on which spacer tape 1, 1' is required for the production of a special insulating glass pane, is applied to the glass pane 40. Thus, the laborious threading and unthreading of spacer tapes 1, 1' in the device is not necessary, and time is saved.

The invention claimed is:

1. A device for applying flexible spacer tapes on glass panes (40) during production of insulating glass panes, comprising:

a device (23, 24) for supporting a glass pane (40), to which spacer tape is to be applied;

a supply reel (2) for a first spacer tape (1); and an application head (20), wherein at least one additional supply reel (2') for a second spacer tape (1'), which is different from the first spacer tape (1), is assigned to the application head (20), wherein the application head (20) has located thereon an orienting system (70, 71) that orients either of the first or the second spacer tape (1 or 1') that is selected in each case relative to a feed device (80) for spacer tape (1 or 1'), wherein an unselected spacer tape (1, 1') is clamped in a region of the orienting system (70), and wherein a coating station (10) with two nozzle pairs (11, 12) is provided on the application head (20) for applying adhesive to lateral surfaces of the selected spacer tape (1 or 1').

2. The device according to claim 1, wherein a system for sag adjustment with sensors (30, 31) is provided between the application head (20) and each of the two supply reels (2, 2').

3. The device according to claim 1, wherein a common supply (13, 14, 15) with adhesive is assigned to the nozzle pairs (11, 12).

4. The device according to claim 1, wherein a device (50) for cutting spacer tape (1 or 1') into lengths is provided on the application head (20).

5. The device according to claim 4, wherein a system (51) for producing V-shaped cutaways in either of the first or the second spacer tape (1 or 1') is provided on the application head (20).

6. The device according to claim 1, wherein a distance between the nozzles (11, 12) in the coating station (10) is adaptable to a width of the selected spacer tape (1, 1') by having the distance between them be variable.

7. The device according to claim 1, wherein the device for supporting the glass pane (40), to which either of the first or second spacer tape (1 or 1') is to be applied, comprises a support wall (23) and a linear conveyor (25).

8. The device according to claim 1, wherein a device (25, 26, 27) for moving the glass pane (40) is provided in a direction of movement of the application head (20).

9. The device according to claim 1, further comprising:

deflecting rollers (65, 67) of the first and second spacer tapes (1, 1') provided on the application head (20) that feeds the selected tape, said deflecting rollers (65, 67) being driven independently of one another.

10. The device according to claim 1, wherein the orienting system (70) is adjustable crosswise to a pathway of the first or second spacer tape (1, 1').

11. The device according to claim 1, wherein the feed device (80) has two feed cylinders (81, 83) that are driven in rotation.

12. The device according to claim 11, wherein a device (50) for cutting either of the first or second spacer tape (1 or 1') into lengths and a system (51) for producing V-shaped cutaways in either of the first or the second spacer tape relative to a direction of movement of the first or the second spacer tape is provided after the feed device (80) or the coating station (10).

13. The device according to claim 1, wherein sag adjustment units with sensors (30, 31) are provided connected to each supply reel (2, 2') for the first and second spacer tapes (1, 1'), which are functionally coupled to a rotating drive for the supply reels (2, 2').

14. The device according to claim 1, wherein a system with sensors to adjust the sagging between the feed rollers (93) for either of the first or the second spacer tape (1, 1') and deflecting rollers (65, 67) is provided in the application head (20).

15. The device according to claim 11, wherein roller pairs (91 and 93) are provided in the application head (20) and are driven based on the feed cylinders (81, 83) of the feed device (80).

16. The device according to claim 1, wherein the adhesive is an adhesive based on butyl rubber.

17. The device according to claim 5, wherein the system (51) for producing V-shaped cutaways is combined with the device (50) for cutting spacer tape (1 or 1') into lengths.

18. A device for applying flexible spacer tapes on glass panes (40) during production of insulating glass panes, comprising:

a device (23, 24) for supporting a glass pane (40), to which spacer tape is to be applied;

a supply reel (2) for a first spacer tape (1);

an application head (20);

a device (25, 26, 27) for moving the glass pane (40) provided in a direction of movement of the application head (20); and at least one of a vacuum suction device and a vacuum conveyor belt (26), wherein at least one additional supply reel (2') for a second spacer tape (1'), which is different from the first spacer tape (1), is assigned to the application head (20), wherein the application head (20) has located thereon an orienting system (70, 71) that orients either of the first or the second spacer tape (1 or 1') that is selected in each case relative to a feed device (80) for spacer tape (1 or 1'), and wherein an unselected spacer tape (1, 1') is clamped in a region of the orienting system (70).

19. A device for applying flexible spacer tapes on glass panes (40) during production of insulating glass panes, comprising:

a device (23, 24) for supporting a glass pane (40), to which spacer tape is to be applied;

a supply reel (2) for a first spacer tape (1); and an application head (20), wherein at least one additional supply reel (2') for a second spacer tape (1'), which is different from the first spacer tape (1), is assigned to the application head (20), wherein the application head (20) has located thereon an orienting system (70, 71) that orients either of the first or the second spacer tape (1 or 1') that is selected in each case relative to a feed device (80) for spacer tape (1 or 1'), wherein the unselected spacer tape (1, 1') is clamped in a region of the orienting system (70), wherein the feed device (80) has two feed cylinders (81, 83) that are driven in rotation, wherein deflecting rollers (65, 67) for the first and second spacer tapes (1, 1') are provided on the application head (20), and wherein a device (10) for coating the first and second spacer tapes (1, 1') with adhesive relative to a direction of movement of the first and second spacer tapes (1, 1') is provided upstream of the deflecting rollers (65, 67) or the orienting system (70) or the feed device (80).

* * * * *